US008040029B2

(12) United States Patent
Agneray et al.

(10) Patent No.: US 8,040,029 B2
(45) Date of Patent: Oct. 18, 2011

(54) SPARK PLUG FOR MOTOR VEHICLE INTERNAL COMBUSTION ENGINE

(75) Inventors: Andre Agneray, Boulogne Billancourt (FR); Marc Pariente, Paris (FR)

(73) Assignee: Renault S.A.S., Boulogne-Billancourt (FR)

( * ) Notice: Subject to any disclaimer, the term of this patent is extended or adjusted under 35 U.S.C. 154(b) by 514 days.

(21) Appl. No.: 12/090,722

(22) PCT Filed: Sep. 21, 2006

(86) PCT No.: PCT/FR2006/050923

§ 371 (c)(1), (2), (4) Date: Aug. 6, 2008

(87) PCT Pub. No.: WO2007/045776

PCT Pub. Date: Apr. 26, 2007

(65) Prior Publication Data

US 2008/0284303 A1 Nov. 20, 2008

(30) Foreign Application Priority Data

Oct. 18, 2005 (FR) ..... 05 53149

(51) Int. Cl.
*F02M 57/06* (2006.01)
*H01T 13/00* (2006.01)
*H01T 13/20* (2006.01)

(52) U.S. Cl. ..... 313/118; 313/136; 313/137; 313/144; 313/145

(58) Field of Classification Search ..... None
See application file for complete search history.

(56) References Cited

U.S. PATENT DOCUMENTS

| | | | | |
|---|---|---|---|---|
| 6,229,253 | B1 * | 5/2001 | Iwata et al. | 313/141 |
| 7,652,414 | B2 * | 1/2010 | Jaffrezic et al. | 313/143 |
| 7,741,761 | B2 * | 6/2010 | Jaffrezic et al. | 313/141 |

FOREIGN PATENT DOCUMENTS

| | | |
|---|---|---|
| DE | 100 15 916 | 10/2001 |
| FR | 2 859 831 | 3/2005 |
| FR | 2859830 A1 | 3/2005 |
| FR | 2859869 A1 | 3/2005 |

OTHER PUBLICATIONS

U.S. Appl. No. 11/719,403, filed May 16, 2007, Jaffrezic, et al.
U.S. Appl. No. 11/814,855, filed Jul. 26, 2007, Jaffrezic, et al.
U.S. Appl. No. 11/993,930, filed Dec. 26, 2007, Jaffrezic, et al.
U.S. Appl. No. 11/911,053, filed Oct. 9, 2007, Malek, et al.
U.S. Appl. No. 12/064,472, filed Feb. 22, 2008, Jaffrezic, et al.

* cited by examiner

*Primary Examiner* — Natalie Walford
(74) *Attorney, Agent, or Firm* — Oblon, Spivak, McClelland, Maier & Neustadt, L.L.P.

(57) ABSTRACT

A spark plug for a motor vehicle internal combustion engine, substantially elongated in shape, and including: two coaxial electrodes of an inner central electrode and an outer base electrode enclosing the central electrode; and an electrically insulating annular block, interposed between the central electrode and the base electrode and including an annular shoulder. The insulating annual block includes an annular groove located at the shoulder.

10 Claims, 2 Drawing Sheets

SPARK PLUG FOR MOTOR VEHICLE INTERNAL COMBUSTION ENGINE

BACKGROUND

The invention relates to a spark plug for the internal combustion engine of a motor vehicle, of essentially elongated general shape, comprising:

- two coaxial electrodes: an inner electrode with an axis called a central electrode and an outer electrode called a body surrounding the central electrode; and
- an electrically insulating block called an insulator, placed between the central electrode and the body, of annular shape and having an annular shoulder.

Plasma-generating plugs are high frequency multi-spark ignition systems, capable of providing the best quality ignition conditions in controlled-ignition engines, while at the same time reducing polluting emissions, in particular with a lean mixture. On the other hand, they are subject to fouling, in particular when cold.

Like all plugs, they are classified in terms of a heat range. This heat range takes into account their thermal behavior at particular moments of engine operation. It expresses in particular their ability to withstand temperatures which are high enough to remove the fouling by pyrolysis, without causing any 'pre-ignition'.

The publications FR2,859,830, FR2,859,869 and FR2,859,831 mention a multi-spark plug, called a cold plug because its temperature does not rise fast enough to prevent fouling. On such plugs, in fact, the accumulation has been observed of a deposit of carbon on the insulator, which significantly reduces the insulation which is required between the tip of the central electrode and the body. With poor insulation, the high voltage supply of the plug could then be too low to be able to cause the required spark-generating 'flashovers'.

To prevent the formation of deposits containing carbon, in particular when cold, on the insulator of the plug exposed to the environment in the combustion chamber, an effort can be made to increase the temperature of the insulator, so as to promote the destruction of the deposits by the phenomenon of pyrolysis, of which the efficiency depends on the thermal resistance of the plug assembly, including that of the insulator.

The measures usually taken to increase the temperature of the insulator are limited by the occurrence of 'pre-ignition' on the plugs, when they reach operating temperatures which are too high.

BRIEF SUMMARY

In order to overcome these disadvantages, the invention aims to adjust the heat range of a multi-spark plug so that it behaves like a very hot plug when the engine is still cold and so that it behaves like a lukewarm plug when the engine is hot.

The invention aims to increase the surface temperature of the insulator while at the same time preserving its electrically insulating properties.

For this purpose, the invention provides a plug of the type mentioned above, characterized in that the insulator comprises an annular groove.

According to other features of the invention, the groove is located on the shoulder.

According to other features of the invention, the groove has a rectangular cross section.

According to other features of the invention, the groove has a triangular cross section.

BRIEF DESCRIPTION OF THE DRAWINGS

Other features and advantages of the invention will emerge on reading the description of embodiments with reference to the attached figures.

DETAILED DESCRIPTION

Elements which are the same or similar are designated by the same reference numbers.

As illustrated in FIGS. 1, 2, 3, and 4, a multi-spark plug 1 comprises two coaxial plasma-generating electrodes. An outer electrode called a body 2 is intended to be connected to earth. It surrounds an inner electrode called a central electrode 3, which is essentially cylindrical, with an axis of symmetry D, acting as a high voltage electrode. The materials of the electrodes 2, 3 are selected from a conducting material such as a nickel alloy.

Figure 1:
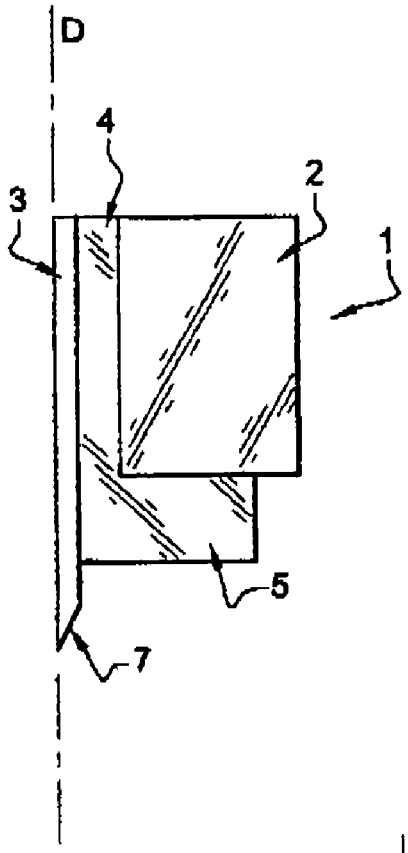
FIG. 1 illustrates a half-section view of a multi-spark plug known in the prior art.

An electrically insulating block, called an insulator 4 is placed between the body 2 and the central electrode 3. The body 2 has, on the outer face of its lower portion nearest to the cylinder head of the internal combustion engine fitted with the plug 1, an appropriate means of positioning, holding in place and tightening the plug 1 in the cylinder head (for example and in a non-limiting manner, as illustrated in FIG. 1; a thread). The insulating material can be selected from ceramics.

The insulator 4 has an annular shoulder 5 covering the whole circular outer surface 6 of the body 2. The shoulder 5 increases the distance, passing through the gaseous mixture, between the central electrode 3 and the body, preventing the creation of an arc between the central electrode 3 and the body 2.

Regardless of the embodiment of the invention, the shoulder 5 comprises an annular groove 8.

Figure 2:
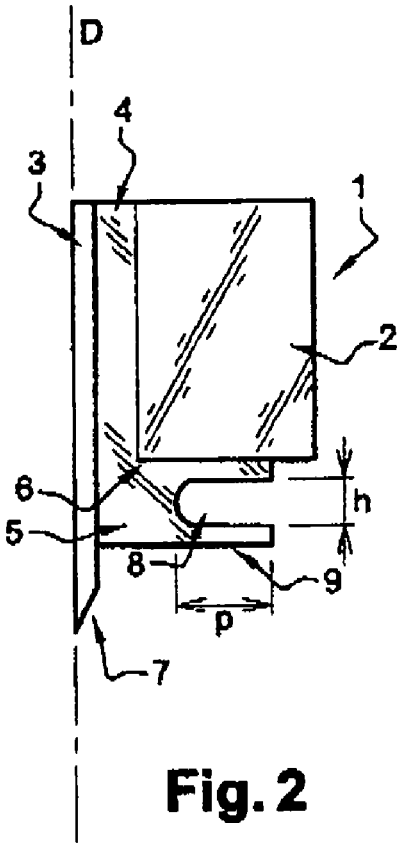
FIG. 2 illustrates a half-section view of a multi-spark plug according to a first embodiment of the invention.

According to a first embodiment, as illustrated in FIG. 2, the annular groove 8 has a rectangular cross section.

Figure 3:
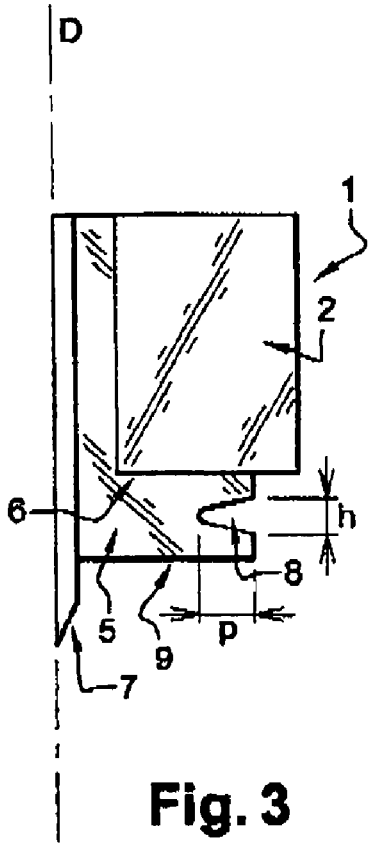
FIG. 3 illustrates a half-section view of a multi-spark plug according to a second embodiment of the invention.
Figure 4:
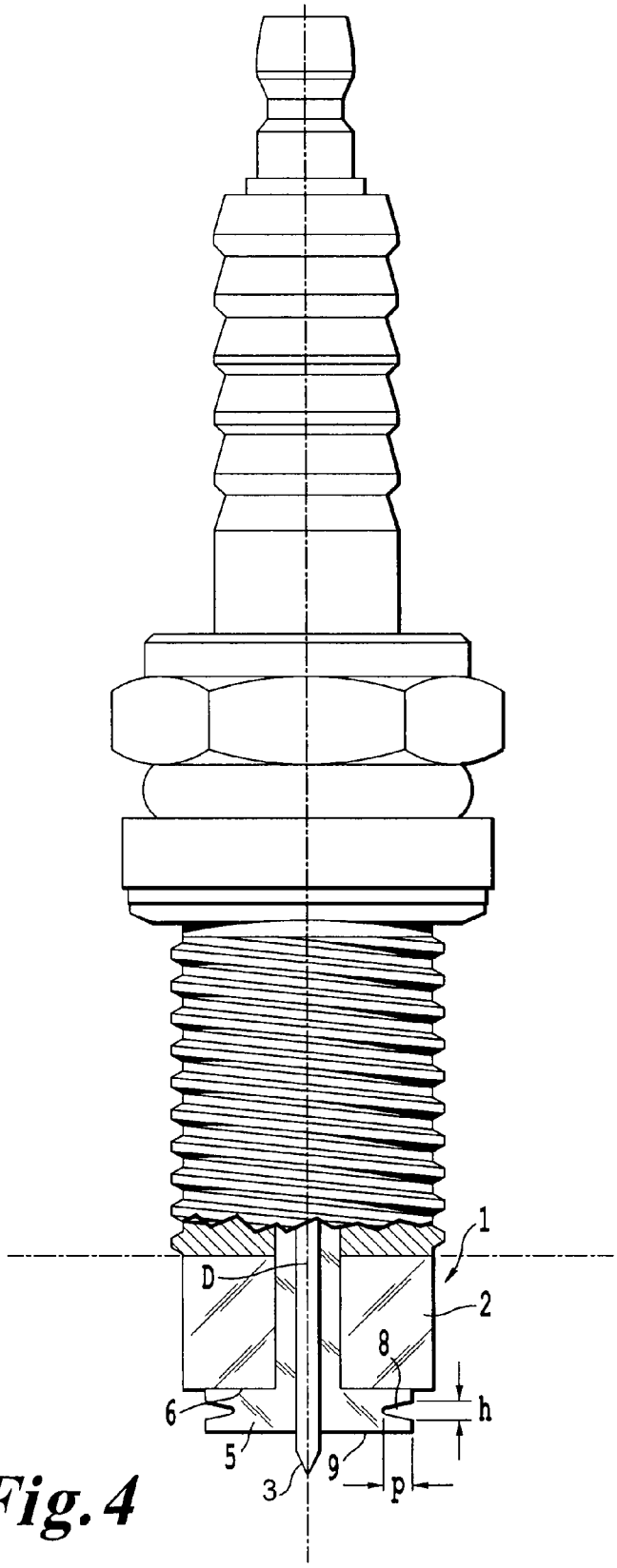
FIG. 4 illustrates a view of an entire multi-spark plug, the sectional view of FIG. 3 being taken from a lower right corner of FIG. 4.

According to a second embodiment, as illustrated in FIG. 3, the annular groove 8 has a triangular cross section.

In this manner, a thermal resistance is created in the center of the insulator and this increases the surface temperature of the insulator 4. The dimensions of this groove 8 are calculated so that the groove cannot be closed, which would result in the non-elevation of the surface temperature.

The groove 8 has two parameters: its height h and its depth p.

The height h adds a heat source inside the insulator 4. The height h varies according to the heat collecting area which alters the distribution of the heat flows entering the insulator.

The depth p of the groove 8 enables the thermal resistance of the system to be adjusted. In tact, the changes in longitudinal thermal conductivity (along the axis D) make it possible to vary the temperature gradients in the axial direction and therefore the temperature distributions.

The shape of the groove 8 is illustrated in FIGS. 2 and 3 but the invention is not limiting, and other shapes can be chosen so as to increase the surface temperature of the insulator.

The groove 8 creates a restriction in the insulator 4 and thus reduces its longitudinal thermal conductivity. In addition, the groove 8 increases the exposed area of the insulator 4 for a smaller volume. This area is entirely exposed to the flame produced by the plug which leads to a greater heat flow from the flame to the insulator 4 and therefore greater heating of the insulator 4. The groove 8 therefore does not prevent the depositing of soot but it increases the temperature of the insulator and enables cleaning of the soot by pyrolysis.

The invention claimed is:

1. A spark plug for an internal combustion engine of a motor vehicle, of essentially elongated general shape, comprising:

two coaxial electrodes including: an inner central electrode with an axis and an outer body electrode surrounding the central electrode; and an electrically insulating block, placed between the central electrode and the body electrode, of annular shape and including an annular shoulder, wherein a portion of the inner central electrode protrudes from the insulating block in a downward direction, wherein the insulating block extends further in the downward direction than the body electrode such that the annular shoulder of the insulating block covers a bottom face of the body electrode, and wherein the insulating block includes an annular groove located on the shoulder.

2. The spark plug as claimed in claim 1, wherein the groove includes a thermal resistance in the insulator.

3. The spark plug as claimed in claim 1, wherein the groove has a rectangular cross section.

4. The spark plug as claimed in claim 2, wherein the groove has a rectangular cross section.

5. The spark plug as claimed in claim 1, wherein the groove has a triangular cross section.

6. The spark plug as claimed in claim 2, wherein the groove has a triangular cross section.

7. The spark plug as claimed in claim 1, wherein the groove is an indentation extending into the annular shoulder.

8. The spark plug as claimed in claim 1, wherein the groove is entirely positioned below the body electrode.

9. The spark plug as claimed in claim 8, wherein the portion of the inner central electrode that protrudes from the insulating block is positioned entirely below the groove.

10. The spark plug as claimed in claim 1, wherein the groove is configured to increase a surface temperature of the insulating block.

* * * * *